US007502576B2

(12) United States Patent
Kubota et al.

(10) Patent No.: US 7,502,576 B2
(45) Date of Patent: Mar. 10, 2009

(54) DEVELOPMENT APPARATUS FOR MIXING RECYCLED DEVELOPER WITH TONER IN A TONER SUPPLY PATH AND IMAGE FORMING APPARATUS HAVING SAME

(75) Inventors: Hiroshi Kubota, Osaka (JP); Yasuyuki Ishiguro, Osaka (JP); Takeshi Takayama, Nara (JP); Jun Yamaguchi, Nara (JP); Hiroshi Kawahito, Nara (JP); Yuhsuke Yoshimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 134 days.

(21) Appl. No.: 11/236,718

(22) Filed: Sep. 28, 2005

(65) Prior Publication Data

US 2006/0078354 A1 Apr. 13, 2006

(30) Foreign Application Priority Data

Oct. 8, 2004 (JP) ..... 2004-296422

(51) Int. Cl.
*G03G 15/08* (2006.01)

(52) U.S. Cl. ..... 399/254

(58) Field of Classification Search ..... 399/359, 399/254

See application file for complete search history.

(56) References Cited

U.S. PATENT DOCUMENTS 4,026,241 A * 5/1977 Takebe et al.
5,510,881 A * 4/1996 Smith et al.
5,592,267 A * 1/1997 Misago et al. ..... 399/359
6,567,631 B2 * 5/2003 Funayama et al. ..... 399/359
6,603,949 B2 * 8/2003 Itoh et al. ..... 399/359
6,711,374 B2 * 3/2004 Funayama et al. ..... 399/359
7,031,644 B2 * 4/2006 Ikeda et al. ..... 399/254
2004/0265009 A1 * 12/2004 Shigeta et al. ..... 399/359
2005/0207794 A1 * 9/2005 Katoh et al. ..... 399/359

FOREIGN PATENT DOCUMENTS

JP 02018585 A * 1/1990
JP 5-313489 A 11/1993
JP 6-208295 A 7/1994
JP 10-39592 2/1998
JP 10-69155 3/1998
JP 10-319721 12/1998
JP 10-319721 A 12/1998

(Continued)

*Primary Examiner*—Susan S Lee
(74) *Attorney, Agent, or Firm*—Nixon & Vanderhye, P.C.

(57) ABSTRACT

By rotating a first and a second screw axle, developer is repeatedly cyclically carried from a first developer path, via an opening portion, a second developer path and an opening to return to the first developer path. While being recirculated and carried, the developer is stuck to an external peripheral face of a development roller, and is carried to a development region between the development roller and a photosensitive drum, wherein an electrostatic latent image on the photosensitive drum is developed by the toner. Furthermore, a first cut-out portion is formed on the first screw axle, and a second and third cut-out portions are formed on the third screw axle, and thus by allowing the developer to back flow from the recycle transport path to the toner supply path, the developer can mix with the toner in the toner supply path, and it is possible to prevent solidification of the toner in the toner supply path.

3 Claims, 6 Drawing Sheets

FOREIGN PATENT DOCUMENTS

| | | | |
|---|---|---|---|
| JP | 11-160992 | A | 6/1999 |
| JP | 2000-181225 | A | 6/2000 |
| JP | 2001-265098 | | 9/2001 |
| JP | 2003-114576 | | 4/2003 |
| JP | 2003-270946 | A | 9/2003 |

* cited by examiner

DEVELOPMENT APPARATUS FOR MIXING RECYCLED DEVELOPER WITH TONER IN A TONER SUPPLY PATH AND IMAGE FORMING APPARATUS HAVING SAME

BCKGROUND

This application claims priority under 35 U.S.C. § 119(a) on Patent Application No. 2004-296422 filed in Japan on Oct. 8, 2004, the entire contents of which are hereby incorporated by reference.

The present invention relates to development apparatuses in electrographic image forming apparatuses, and to image forming apparatuses using the same.

Generally, image forming apparatuses such as copiers, printers and facsimile machines form a latent image on a photosensitive body, supply developer from a development apparatus to the photosensitive body, develop the electrostatic latent image on the photosensitive body using the developer to form a developed image on the photosensitive body, transfer the developed image from the photosensitive body to recording paper, and heat and pressure the recording paper to fix the developed image onto the recording paper.

For the development apparatus, there are devices such as shown in FIG. 7. With this device, a first and a second developer path 301 and 302 are aligned side by side, the developer paths 301 and 302 are separated by a separating wall 303, and moreover, by forming opening portions 304 and 305, the developer paths 301 and 302 are connected on both sides via the opening portions 304 and 305. Furthermore, a toner supply path 306 is provided above an extension of the first developer path 301. A first and a second screw axle 311 and 312 are arranged in the first and the second developer path 301 and 302 respectively, and a third screw axle 313 that is coaxial with the first screw axle 311 is arranged in the toner supply path 306. Moreover, a development roller 307 is provided beside the second developer path 302, and the development roller 307 is arranged in proximity to the photosensitive body of the image forming apparatus.

Here, a two-component developer made by mixing a toner and a magnetic carrier is contained in the first and the second developer path 301 and 302. When the developer is transported by the first and the second screw axles 311 and 312 by opposably rotating the first and the second screw axles 311 and 312, the developer is repeatedly circulated and carried in a circulatory carry path for recirculating from the first developer path 301, via the opening portion 304, the second developer path 302 and the opening portion 305 to the first developer path 301. While being circulated and carried, the developer sticks to the external peripheral surface of the development roller 307 in the second developer path 302, and is fed to a development region between the development roller 307 and the photosensitive body (not shown) to develop, with toner, the electrostatic latent image on the photosensitive body.

By repeatedly developing the electrostatic latent images, the toner of the developer is consumed, and when the concentration of the toner of the developer gets low, toner is refilled from a supply opening 306*a* in the toner supply path 306. The toner is carried to the first developer path 301 by rotation of the third screw axle 313 in the toner supply path 306, and is mixed with the developer in the first developer path 301. Thus, the concentration of the toner of the developer is returned to its original value (see JP H10-39592A and JP H10-319721A).

However, with conventional development apparatuses, since the developer is carried to the right by the first screw axle 311, there is no back flow of developer G from the first developer path 301 to the toner supply path 306, as shown in FIG. 8. Thus, only a toner T that is refilled from the supply opening 306*a* passes through the toner supply path 306.

On the other hand, although the two-component developer made by mixing the toner and the magnetic carrier does not solidify due to moisture or the like, in the case of only toner, the toner will solidify due to moisture, for example.

Thus, if, directly after refilling toner into the toner supply path 306 from the supply opening 306*a* because of a decrease in the concentration of the toner of the developer, the development apparatus (the image forming apparatus) is stopped, and is left as it is until after a holiday or the like, then problems will occur such as the toner solidifying inside the toner supply path 306 to lock the third screw axle 313, thus locking the first screw axle 311, for example.

Thus, one or more example embodiments have been achieved with a view to the aforementioned conventional problems, and it is an object of one or more example embodiments to provide a development apparatus and an image forming apparatus to suppress solidifying of the toner in the supply path.

SUMMARY

In order to solve the aforementioned issues, a development apparatus has a developer recycle carry path for supplying, for the purpose of developing, toner that is to be contained in a developer, while recycling and carrying the developer, and a toner supply path that is branch-connected to the developer recycle carry path, the toner being refilled into the developer recycle carry path via the toner supply path, wherein the development apparatus includes developer introduction means for guiding some of the developer that is recycled and carried in the developer recycle carry path into the toner supply path, and for mixing with the toner in the toner supply path.

With an example embodiment of the development apparatus, the developer introduction means is provided for guiding some of the developer that is recycled and carried in the developer recycle carry path into the toner supply path, and for mixing with the toner in the toner supply path. Thus, the toner supply path is introduced with not just toner, but with developer that includes a component other than toner (for example, a magnetic carrier). Since this developer contains a component other than toner, solidifying of the developer due to the absorption of moisture can be suppressed. Consequently, it is possible to prevent a mechanism for carrying the toner or the developer in the toner supply path from locking due to solidifying of the toner.

Furthermore, in the aforementioned configuration, the developer recycle carry path may have a first developer path in which a first screw axle, provided with an external peripheral blade, is arranged, for carrying the developer by the rotation of the first screw axle; and may have a second developer path in which a second screw axle, provided with an external peripheral blade, is arranged, for carrying the developer by the rotation of the second screw axle; and may be a path wherein the first developer path and the second developer path may be connected via two opening portions such that the developer is cyclically carried between the first development path and the second development path, the toner supply path may be a path that is provided, in the vicinity of one of the openings, connected to the first developer path as a branch from the developer recycle carry path and as an extension of the first developer path, and may be a path in which a third screw axle, provided with an external peripheral blade, is disposed, wherein the third screw blade may be coaxial with the first screw blade, and wherein the path may carry the toner to the developer recycle carry path by the third screw axle; and the developer introduction means may be a cut-out portion formed in the blade of the first screw axle of the first developer path in the vicinity of the one of the opening portions.

In this case, the first developer path and the second developer path are connected via the two openings to form the developer recycle carry path, and the toner supply path is provided, connected to the first developer path in the vicinity of one of the openings. Furthermore, in the first and the second developer paths, the developer is cyclically carried through the developer recycle carry path by the first and the second screw axles. Furthermore, in the toner supply path, the toner is carried to the developer recycle carry path by the third screw axle. Moreover, the cut-out portion is formed in the blade of the first screw axle, in the vicinity of one of the opening portions. The cut-out portion of the blade of the first screw axle guides the developer in the developer recycle carry path to the toner supply path, and mixes the developer with the toner in the toner supply path. That is to say, the cut-out portion of the blade of the first screw axle achieves the aim of the developer introduction means, of guiding a part of the developer that is cyclically carried in the developer recycle carry path to the toner supply path, and mixing the developer with the toner in the toner supply path.

Moreover, the developer introduction means may be at least one other cut-out portion formed in the blade of the third screw axle in the toner supply path.

In this case, since at least one other cut-out portion is formed in the blade of the third screw axle of the toner supply path, it is possible to reduce the carrying power of the third screw axle, and increase the amount of developer that is guided from the developer recycle carry path to the toner supply path.

Furthermore, in order to solve the aforementioned issues, an example embodiment of an image forming apparatus is provided with image forming stations that form each of the developed images, lined up in tandem, wherein the image forming stations are each provided with any one of the example embodiments of the development apparatuses.

With an example embodiment of the image forming apparatus according, one or more example embodiments of the development apparatuses are each attached to image forming station that are arranged in tandem. In order to make such an image forming apparatus more compact, it is necessary to reduce the size of the image forming stations, and thus it is preferable to apply a development apparatus that is compact, to be the development apparatus of the image forming stations. One or more example embodiment of the development apparatus refills the toner to the developer recycle carry path via the toner supply path, and thus by offsetting the toner cartridge that refills the toner, with respect to the development apparatus, it is possible to reduce the area occupied by the toner cartridge, and by extension, to reduce the area occupied by the development apparatus. Consequently it is possible to reduce the area occupied by the image forming stations, and to achieve the effect of realizing the miniaturization of the image forming apparatus.

DESCRIPTION EXAMPLE EMBODIMENTS

An image forming apparatus that is provided with an example embodiment of the development apparatus is described below with reference to the drawings.

Description of the Entire Image Forming Apparatus

Figure 1:
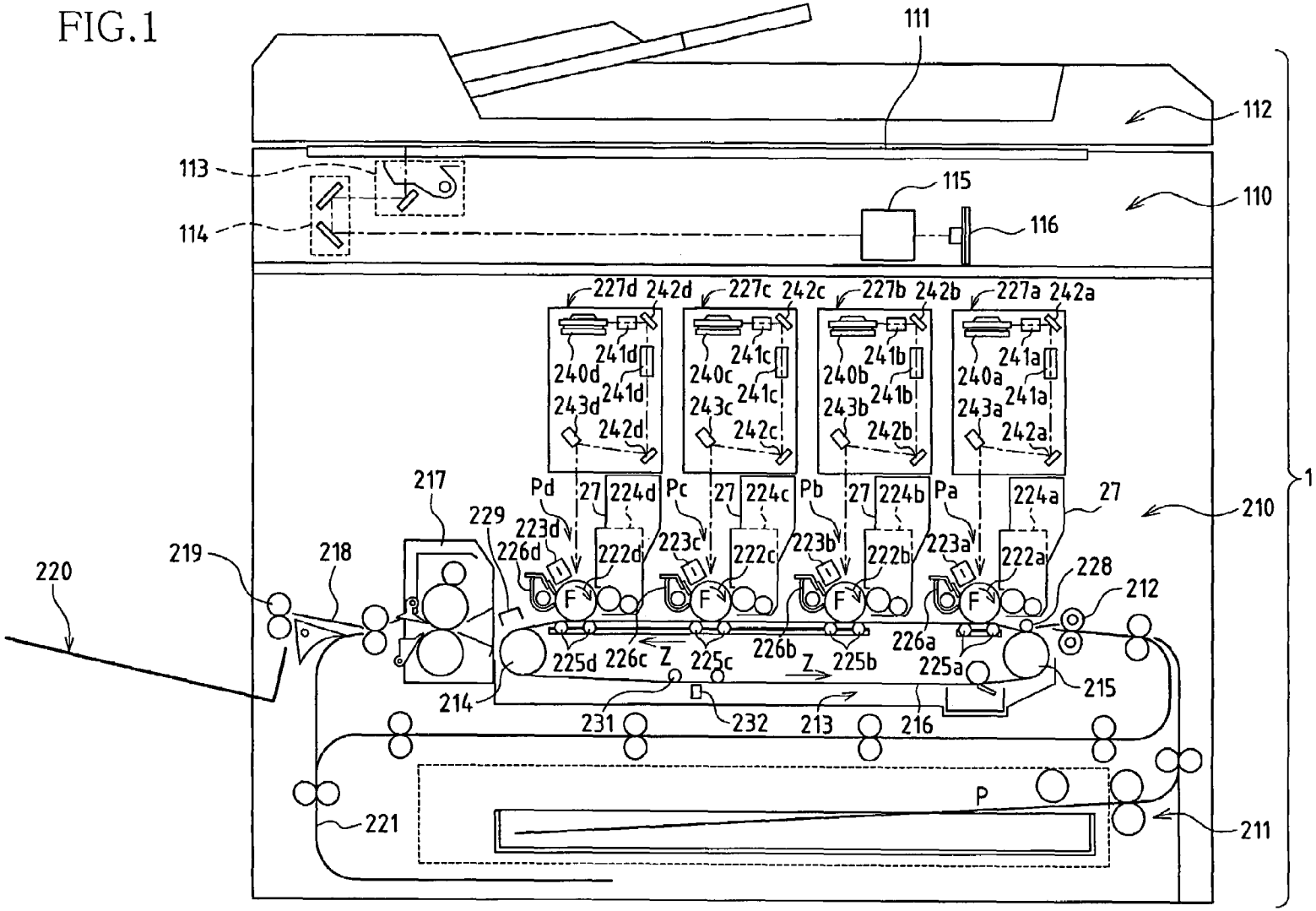
FIG. 1 is a cross-sectional overview showing a configuration of a digital colour copier that is provided with one example embodiment of a development apparatus.

FIG. 1 is a cross-sectional overview showing a configuration of a digital colour copier (referred to hereinafter simply as a copier) 1 as the colour image forming apparatus according to the present embodiment. The copier 1 is provided with a reverse automatic document feeder (shortened to "RADF" below) 112, an image reading portion 110 and an image forming portion 210.

An upper face of the main unit of the copier 1 is provided with a document platen 111 and a control panel, which will be described later. The RADF 112 is supported on the upper face side of the document platen 111, in a state so as to be capable of opening and closing on the document platen 111.

Firstly, the RADF 112 carries the document so that one face of the document faces the image reading portion 110 in a predetermined position. Then, after the image on the one face has been read in, the document is carried such that it is overturned to face the document platen 111 so that the other face faces the image reading portion 110 in a predetermined position of the document platen 111. After both sides of the one page of the document have been read, the RADF 112 discharges the document, and performs the two-sided carry operation on the next document. The aforementioned carrying and paper reversing operations are controlled in association with the operations of the main unit of the copier 1.

The image reading portion 110 is arranged below the document platen 111 in order to read in the image of the document that is carried onto the document platen 111 by the RADF 112. The image reading portion 110 has document scanning bodies 113 and 114 that travel back and forth in parallel along the lower face of the document platen 111, an optical lens 115, and a CCD line sensor 116, which is a photoelectric transducer.

The document scanning bodies 113 and 114 are constituted from a first scanning unit 113 and a second scanning unit 114. The first scanning unit 113 has an exposure lamp for exposing light onto the document image surface, and a first mirror for reflecting the optical image reflected from the document in a predetermined direction. The first scanning unit 113 is controlled so as to move back and forth horizontally at a predetermined velocity while maintaining a constant distance to the lower face of the document platen 111.

The second scanning unit 114 has a second and a third mirror for further reflecting the reflected optical image from the document that is reflected by the first mirror of the first scanning unit 113 in a predetermined direction. The second scanning unit 114 is controlled so as to move back and forth horizontally while maintaining a constant speed relationship with the first scanning unit 113.

The optical lens 115 reduces the reflected image from the document that is reflected by the third mirror of the second scanning unit 114, and focuses the reduced image onto the CCD line sensor 116. The optical lens 115 may be constituted by a plurality of lens groups, for example.

The CCD lines sensor 116 photoelectrically converts the focused optical image, and outputs it as an electric signal. The CCD line sensor 116 may be constituted, for example, by a three line colour CCD that reads a black and white, or colour image, and that is capable of outputting line data that is chromatically separated into the colour components of R (red), G (green) and B (blue). The document image information that is converted into electric signals by the CCD line sensor 116 is further transferred to an image processing portion (not shown) where predetermined image data processing is performed.

The configuration of the image forming portion 210, and the configuration of the parts relating to the image forming portion 210, will be described next. A paper feed mechanism 211 for separating paper (recording paper) P that has been stacked in the paper tray one by one and feeding it toward the image forming portion 210 is provided below the image forming portion 210. The paper P that is separated and fed one by one is carried to the image forming portion 210 by a pair of register rollers 212 that are arranged in front of the image forming portion 210, and whose timing is controlled. Moreover, for the paper P on whose one face an image is formed, its timing is matched to the image forming of the image forming portion 210, to re-supply the paper to the image forming portion 210.

A transfer carry belt mechanism 213 is arranged beneath the image forming portion 210. The transfer carry belt mechanism 213 is configured to electrostatically fix the paper P to and carry the paper P by a transfer carry belt 216 that is stretched to extend substantially parallel between a drive roller 214 and a driven roller 215. A pattern image detecting unit is arranged proximately on the under side of the transfer carry belt 216.

Moreover, a fixing device 217 is arranged on the downstream side of the transfer carry belt mechanism 213 in the paper carry path for fixing to the paper P the toner image that is transferred to and formed on the paper P. The paper P that passes through the nip between the pair of fixing rollers of the fixing device 217 passes via a switching gate 218 for switching the carry direction, and is discharged by a discharge roller 219 onto a discharge tray 220 that is attached to an external wall of the main unit of the copier 1.

The switching gate 218 selectively switches the carry path of the paper P after fixing between the path to discharge the paper P to the main unit of the copier 1 and a path to re-feed the paper P toward the image forming portion 210. The paper P whose carry direction is switched by the switching gate 218 again toward the image forming portion 210 is re-fed to the image forming portion 210 after being reversed via the switchback carry path 221.

Furthermore, a first image forming station Pa, a second image forming station Pb, a third image forming station Pc and a fourth image forming station Pd are arranged in that order in parallel from the upstream side of the paper carry path, above the transfer carry belt 216 of the image forming portion 210, in proximity to the transfer carry belt 216. The transfer carry belt 216 is frictionally driven by the drive roller 214 in the direction shown by the arrow Z in FIG. 1, to support the paper P that is supplied via the paper feed mechanism 211 as described above and to sequentially carry the paper P to the image forming stations Pa to Pd.

The image forming stations Pa to Pd have substantially the same configuration. The image forming stations Pa to Pd each include photosensitive drums 222*a* to 222*d* that are rotatably driven in the direction of and arrow F shown in FIG. 1.

Chargers 223*a* to 223*d* for similarly charging the photosensitive drums 222*a* to 222*d*, development apparatuses 224*a* to 224*d* for developing the latent images formed on the photosensitive drums 222*a* to 222*d* respectively, transfer dischargers 225*a* to 225*d* for transferring the toner images that are developed on the photosensitive drums 222*a* to 222*d* onto the paper P and cleaning devices 226*a* to 226*d* for removing the toner that is residual on the photosensitive drums 222*a* to 222*d* are sequentially arranged in the rotating direction of the photosensitive drums 222*a* to 222*d* in the vicinity of the photosensitive drums 222*a* to 222*d*.

Laser beam scanning units (light exposing devices) 227*a* to 227*d* are provided above each of the photosensitive drums 222*a* to 222*d*. The laser beam scanner units 227*a* to 227*d* are configured, for example, from semiconductor laser elements (not shown) for emitting dot light that is modulated in accordance with image data, polygon mirrors (polarizing devices) 240*a* to 240*d* for polarizing the laser beams from the semiconductor laser elements in the principal scanning direction, and fθ lenses 241*a* to 241*d* and mirrors 242*a* to 242*d* for focusing the laser beams that are polarized by the polygon mirrors 240*a* to 240*d* onto the surface of the photosensitive drums 222*a* to 222*d*.

The laser beam scanner 227*a* is input with pixel signals corresponding to the black color component of the color document image, the laser beam scanner 227*b* is input with pixel signals corresponding to the cyan colour component of the color document image, the laser beam scanner 227*c* is input with pixel signals corresponding to the magenta colour component of the color document image and the laser beam scanner 227*d* is input with pixel signals corresponding to the yellow colour component of the color document image. The latent electrostatic images corresponding to the information of the thus chromatically converted document images are formed on the photosensitive drums 222*a* to 222*d*. The development apparatus 224*a* contains black toner, the development apparatus 224*b* contains cyan toner, the development apparatus 224*c* contains magenta toner, and the development apparatus 224*d* contains yellow toner. The latent electrostatic images on the photosensitive drums 222*a* to 222*d* are developed by these colored toners. Thus, the document image information that is chromatically converted is reproduced as colored toner images in the image forming portion 210.

Furthermore, a paper handling charging unit 228 is provided between the first image forming station Pa and the paper feed mechanism 211. The paper handling charging unit 228 electrostatically charges the surface of the transfer carry belt 216. The paper P that is fed from the paper feed mechanism 211 due to the charge caused by the paper handling charging unit 228 can be carried from the first image forming station Pa to the fourth image forming station Pd while reliably stuck to the transfer carry belt, without offset.

On the other hand, in the region between the fourth image forming station Pd and the fixing device 217, a decharging device 229 is provided in a region that is substantially directly above the drive roller 214. An alternating current for separating the paper P that is electrostatically stuck to the carry belt 216 from the carry belt 216 is applied to the decharging device 229.

The digital color copier having the above configuration uses cut sheets of paper as the paper P. When the paper P is sent out from the paper feed cassette supplied into the guide of the paper carry path of the paper feed mechanism 211, the tip portion of the paper P is detected by a sensor (not shown), and is temporarily stopped by the pair of register roller 212, based on the detection signal that is output from the sensor. The paper P is then sent, with timing matched to the image forming stations Pa to Pd, to the transfer carry belt 216 that rotates in the direction of the Z arrows in FIG. 1. At this time, a predetermined electrostatic charge is applied to the transfer carry belt 216 by the aforementioned paper handling charging unit 228, and thus the paper P can be reliably carried by the force of electrostatic attraction while passing the image forming stations Pa to Pd.

Color toner images are formed for each of the image forming stations Pa to Pd and are transferred such that the color toner images are layered onto the upper face of the paper P that is electrostatically stuck and carried by the transfer belt 216. When the transfer of the image by the fourth image forming station Pd is complete, the paper P is separated by the decharging discharger at the tip portion from the transfer carry belt 216 and guided to the fixing device 217 in sequence. Lastly, the paper P on which the toner image is fixed is discharged from the paper discharge opening (not shown) onto the paper discharge tray 220.

It should be noted that in the configuration displayed above, writing the light onto the photosensitive drums 222*a* to 222*d* is performed by scanning the laser beams to expose light using the laser beam scanner units 227*a* to 227*d*. On the other hand, it is also possible to constitute a writing optical system (LED unit) made from a light emitting diode array and a focusing lens array, as a substitute for the laser beam scanning unit. The size of the LED head is smaller than the laser beam scanner unit, and because it has no moving parts, the LED head has superior silent running. Thus, LED heads can be suitably used in image forming apparatuses such as tandem-type digital color copiers which require a plurality of writing units.

Description of the Development Apparatus of the Present Embodiment

Figure 2:
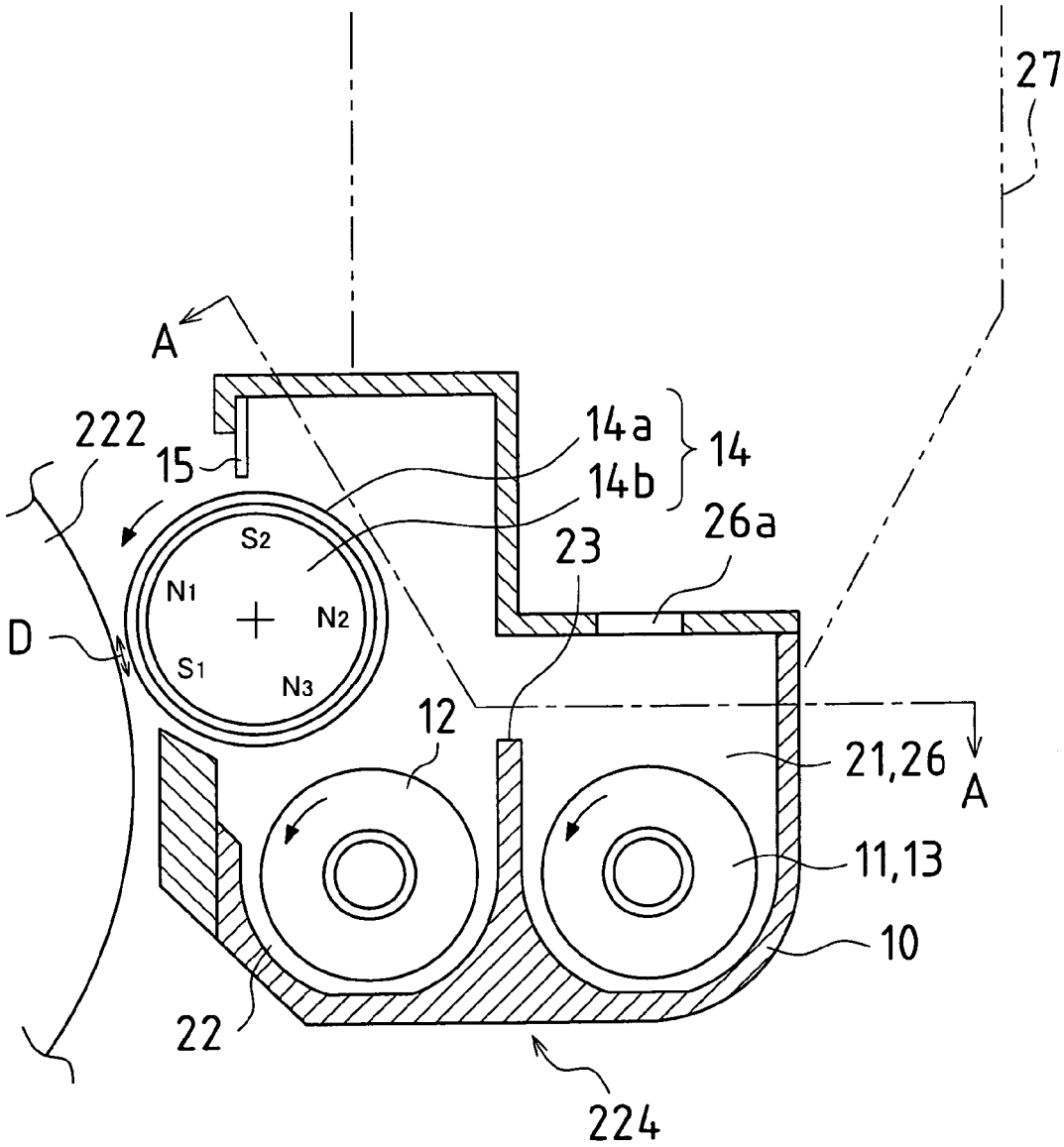
FIG. 2 is a lateral view showing an overview of the development apparatus of example embodiment.
Figure 3:
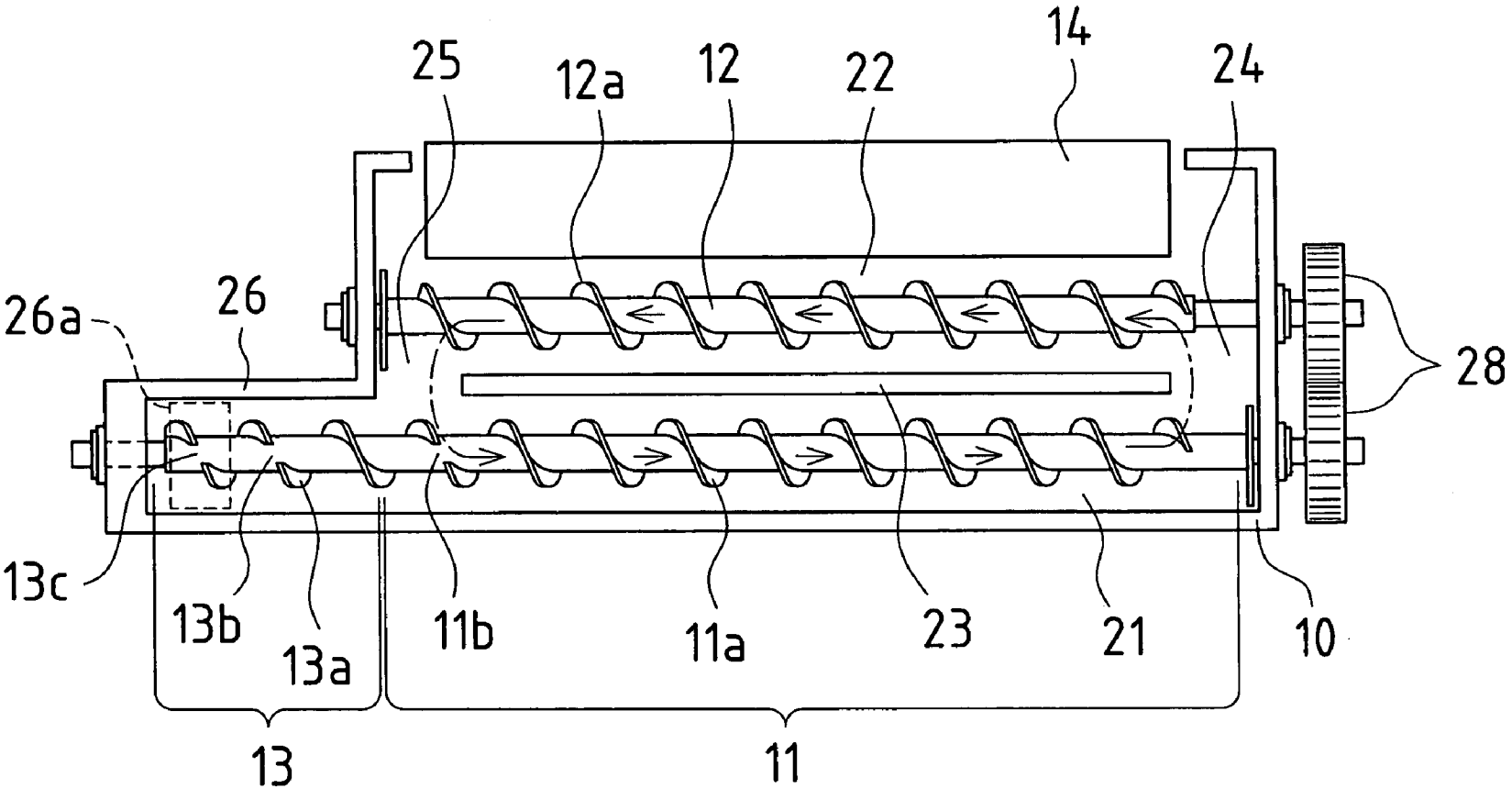
FIG. 3 is a cross-sectional view along A-A of FIG. 2.

FIG. 2 is a lateral view schematically showing the development apparatuses 224*a* to 224*d*. FIG. 3 is a cross-sectional view along A-A in FIG. 2.

The development apparatuses 224*a* to 224*d* (for simplicity, the symbols 224*a* to 224*d* are referred to below as symbol 224) contain a two-component developer that is a mixture of a magnetic carrier and toner in a case 10, and supplies the toner in the developer to the photosensitive drums 222*a* to 222*d* (for simplicity, the symbols 222*a* to 222*d* are referred to as symbol 222) to develop the electrostatic latent image on the surface of the photosensitive drum 222, and to form the toner image on the surface of the photosensitive drum 222.

The development apparatus 224 rotates a first screw axle 11 and a second screw axle 12 that are arranged at the bottom of the case 10 to agitate the developer, and by frictional electrostatic charging due to the agitation, applies an electric charge to the magnetic carrier and the toner.

A development roller 14 fastens a rod-shaped multi-polar magnet 14*b*, and supports a non magnetic sleeve (such as an aluminium alloy or stainless steel) around the multi-polar magnet 14*b* such that it can freely rotate, wherein the sleeve rotates while sticking and carrying the developer on the external periphery of the sleeve 14*a* via the magnetic force of the magnet 14*b*.

As the sleeve 14*a* rotates, after the layer thickness of the developer on the exterior of the of the sleeve 14*a* is controlled by a layer thickness control member 15, the layer of the developer on the exterior of the sleeve 14*a* is carried to a development region D between the sleeve 14*a* and the photosensitive drum 222.

The toner in the developer layer on the exterior of the sleeve 14*a* is frictionally electrically charged by the agitation of the first and second screw 11 and 12 to a polarity that is the opposite of that of the latent electrostatic image on the surface of the photosensitive drum 222. Thus, when the developer layer of the external periphery of the sleeve 14*a* reaches the development region D between the sleeve 14*a* and the photosensitive drum 222, the toner in the developer layer sticks to the electrostatic latent image on the surface of the photosensitive drum 222, and the electrostatic latent image becomes the toner image.

On the other hand, in the bottom of the case 10 of the development apparatus 224, first and second development paths 21 and 22 are arranged side by side, the developer paths 21 and 22 are divided by a dividing wall 23, and by forming opening portions 24 and 25, the development paths 21 and 22 are connected on both sides via the opening portions 24 and 25. Furthermore, a toner refill path 26 is provided as an extension of the first developer path 21. The first and the second screw axle 11 and 12 are arranged in the first and the second developer paths 21 and 22 respectively, and a third screw axle 13 is arranged in the toner refill path 26, coaxial with the first screw axle 11. Moreover, a drive gear 28 of the first and the third screw axles 11 and 13, and a drive gear 28 of the second screw axle 12 are meshed together on the exterior of the case 10. The development roller 14 is provided beside the second developer path 22.

The first, the second and the third screw axles 11, 12 and 13 are provided with helical blades 11*a*, 12*a* and 13*a* around the external periphery of the rotating axles.

Here, a two-component developer made of a mixture of a toner and a magnetic carrier is contained in the first and the second development paths 21 and 22, and when the developer is carried by the first and the second screw axles 11 and 12 by the opposable rotation of the first and the second screw axles 11 and 12, the developer is repeatedly cycled through a recycle carry path that recycles from the first developer path 21 via the opening 24, the second developer path 22 and the opening 25, to the first developer path 21. While being recirculated and carried, the developer sticks to the outer peripheral surface of the development roller 14 in the second developer path 22, and is carried to the development region D between the development roller 14 and the photosensitive drum 222, wherein the toner develops the electrostatic latent image on the photosensitive drum 222.

Furthermore, by repeatedly developing the electrostatic latent images, the toner in the developer is consumed, and when the toner concentration in the developer drops, the toner is refilled from the toner cartridge 27 into the toner supply path 26 via the supply opening 26*a* of the toner supply path 26. The toner is carried to the first developer path 21 by the rotating third screw axle 13 in the toner supply path 26 to mix with the developer in the first developer path 21. Thus, the concentration of the toner in the developer is returned to its original value.

However, assuming, for example, that the development apparatus 224 stops while in the state in which the toner is refilled into the toner supply path 26. If the development apparatus 224 is left as it is in a stopped state for a number of days, then the toner in the toner supply path 26 will solidify, the third screw axle 13 will lock, and thus the first screw axle 11, and the like, will also lock up.

Here, in the development apparatus 224 of the present embodiment, a first cut-out portion 11*b* is formed in the helical blade 11*a* of the first screw axle 11, and a second cut-out portion 13*b* and a third cut-out portion 13*c* are formed in the helical blade portion 13*a* of the third screw axle 13, wherein these are used to allow the developer that contains the magnetic carrier to back flow from the recycle carry path into the toner supply path 26 to mix the developer into the toner in the toner supply path 26, and to prevent solidifying of the toner in the toner supply path 26.

Figure 4:
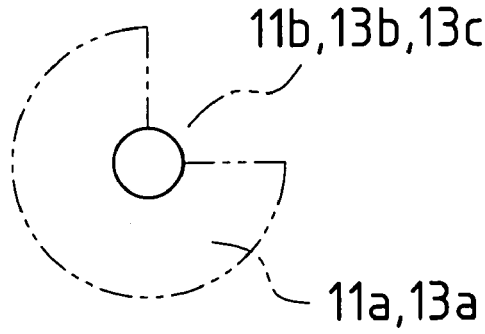
FIG. 4 is a lateral view showing a cutaway of a spiral blade of a screw axle of the development apparatus in FIG. 1.

The first, second and third cut-out portions 11*b*, 13*b* and 13*c* are formed in the helical blade 11*a* or 13*a* of the screw axles, as shown in FIG. 4, by cutting out a 90° fan-shaped region centered on said screw axle.

The first cut-out portion 11*b* on the first screw axle 11 is formed in the vicinity of the opening portion 25. Thus, when the developer is carried from the second developer path 22 to the first developer path 21 via the opening portion 25, some of the developer is introduced to the toner supply path 26 through the first cut-out portion 11*b* of the first screw axle 11. Furthermore, because the second and the third cut-out portions 13*b* and 13*c* are formed in the third screw axle 13, the force for carrying the toner of the third screw axle 13 is weakened. Thus, when the developer is steadily introduced into the toner supply path 26 via the first cut-out portion 11*b* in the first screw axle 11, this developer gradually back flows into the toner refilling portion 26 against the toner carrying power of the third screw axle 13. Thus, as shown in FIG. 5, the developer G is introduced up to the back of the toner supply path 26.

Figure 5:
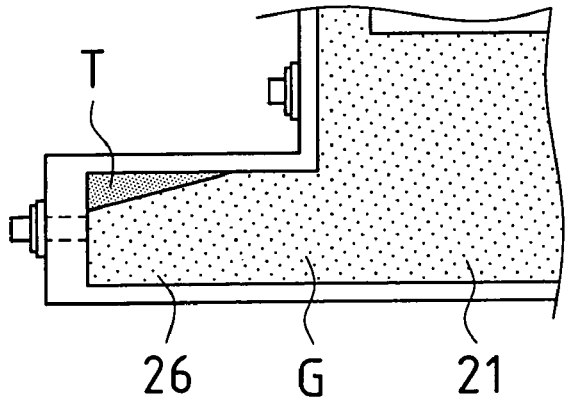
FIG. 5 is a view showing how the developer is introduced into the toner supply path of the development apparatus in FIG. 1.

As this time, when the toner is refilled into the toner supply path 26 from the toner cartridge 27 via the supply opening 26*a*, although the toner T is temporarily deflected into a corner of the toner supply path 26, as shown in FIG. 5, the toner T is carried by the third screw axle 13 and is rapidly mixed into the developer G in the toner supply path 26.

When the toner is mixed into the developer in the toner supply path 26 in this way, the developer that contains the magnetic carrier does not solidify due to moisture, or the like, and thus the third screw axle 13 and the first screw axle 11, and the like, do not lock up.

In this way in the present embodiment, since the first cut-out portion 11*b* is formed in the first screw axle 11, and the second and third cut-out portions 13*b* and 13*c* are formed in the third screw axle 13, it is possible to mix the developer with the toner in the toner supply path 26 by allowing the developer to back flow from the recycle carry path into the toner supply path 26, and thus it is possible to prevent the toner from solidifying in the toner supply path 26.

Furthermore, with a configuration in which the image forming stations are lined up in tandem as in the copier 1, in order to make the copier 1 more compact, it is necessary to reduce the size of the image forming stations, and so, obviously, the development apparatus 224 of the image forming stations must also be miniaturized. In the development apparatus 224 of the present embodiment, since the toner is refilled into the recycle carry path through the toner supply path 26, the area occupied by the toner cartridge 27 can be reduced by arranging the toner cartridge 27 offset against the development apparatus 224 and making the toner cartridge more longitudinal. By extension, it is possible to reduce the area occupied by the development apparatus 224. Consequently, it is possible to reduce the area occupied by the image forming stations, making it easier to realize a copier 1 that is more compact.

It should be noted that the present invention is not limited to the aforementioned embodiment, and a multitude of modifications are possible. For example, it is possible to increase or decrease the number of cut-out portions on the first and the third screw axles 11 and 13, and to alter the positions of the cut-out portions.

More specifically, it is possible to guide the developer from the recycle carry path to the toner supply path 26 using just the cut-out portion 11*b* on the first screw axle 11. However, the amount of developer that is guided to the toner supply path 26 will be reduced.

Figure 6:
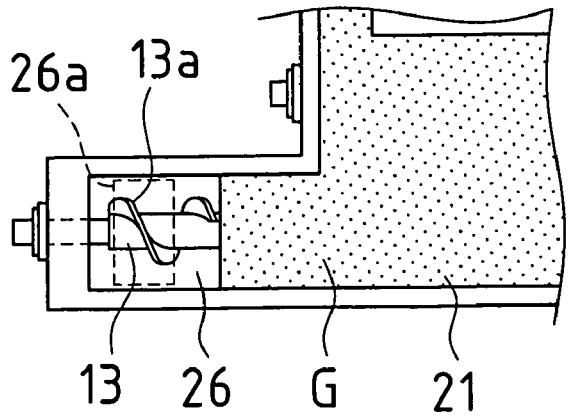
FIG. 6 is a view schematically showing a modified example of the development apparatus in FIG. 1.
Figure 7:
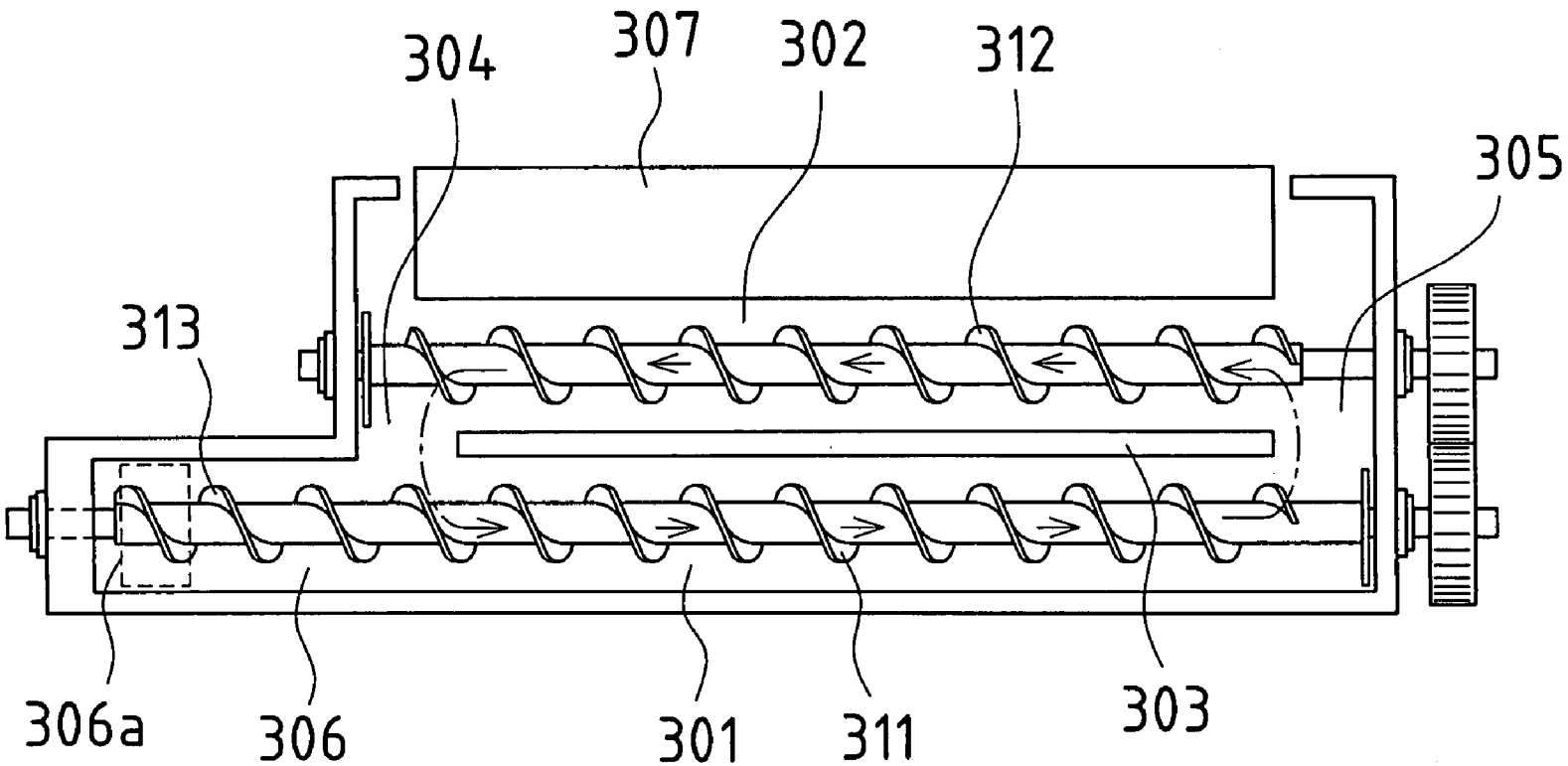
FIG.7 Prior Art
FIG. 7 is a view schematically showing a conventional development apparatus.
Figure 8:
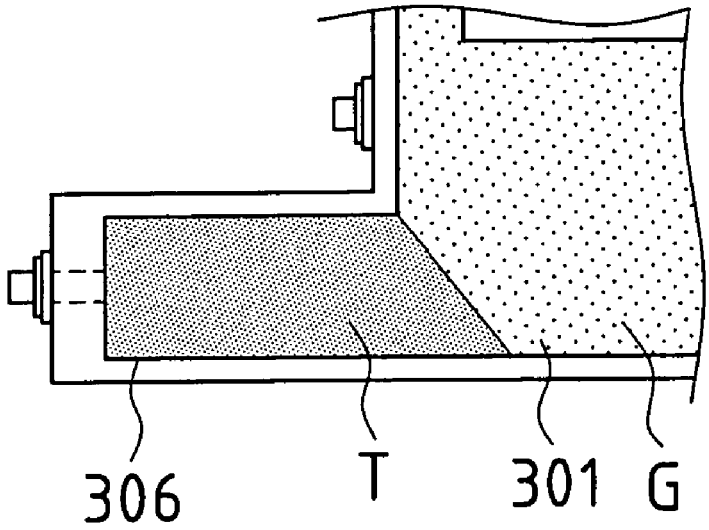
FIG.8 Prior Art
FIG. 8 is a view showing how the toner in the toner supply path flows in the development apparatus of FIG. 7.

Furthermore, it is possible to have only the first cut-out portion 11*b* of the first screw axle 11, and the second cut-out portion 13*b* on the third screw axle 13. In this case, it is possible to guide a sufficient amount of developer to the toner supply path 26 at least to the position of the second cut-out portion 13*b*, as shown in FIG. 6.

Or, it is possible to alter the shape of the cut-out portions. For example, provided that the cut-out portion is formed by cutting out a fan-shaped region from the helical blade of the screw axle that is centered on said screw axle, the center angle of the fan-shaped region may be altered to any angle desired.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A development apparatus including a developer recycle carry path for supplying, for the purpose of developing, toner to be contained in a developer, while recycling and carrying the developer, and a toner supply path that is branch-connected to the developer recycle carry path, the toner being refilled into the developer recycle carry path via the toner supply path, wherein the development apparatus comprises: developer introduction means for guiding some of the developer that is recycled and carried in the developer recycle carry path into the toner supply path, and for mixing with the toner in the toner supply path, wherein the developer recycle carry path comprises:

a first developer path in which a first screw axle, provided with a first external peripheral helical blade, is disposed, for carrying the developer by the rotation of the first screw axle; and a second developer path in which a second screw axle, provided with a second external peripheral helical blade, is disposed, for carrying the developer by the rotation of the second screw axle;

wherein the developer recycle carry path is a path wherein the first developer path and the second developer path are connected via two opening portions such that the developer is cyclically carried between the first development path and the second development path;

wherein the toner supply path is a path that is provided in the vicinity of one of the openings, is connected to the first developer path as a branch from the developer recycle carry path and as an extension of the first developer path, and is a path in which a third screw axle, provided with a third external peripheral helical blade, is disposed;

wherein the third external peripheral helical blade is coaxial with the first external peripheral helical blade, and wherein the path carries the toner to the developer recycle carry path via the third external peripheral helical blade;

wherein the developer introduction means comprises a cut-out portion formed in the first external peripheral helical blade of the first developer path in the vicinity of the one of the opening portions; and wherein the first and second screw axles are configured to be opposably rotated.

2. The development apparatus according to claim 1, wherein the developer introduction means comprises at least one other cut-out portion formed in the third external peripheral helical blade in the toner supply path.

3. An image forming apparatus comprising image forming stations that form each of the developed images, lined up in tandem, wherein the image forming stations are each provided with the development apparatus according to claim 1.

* * * * *